US006101735A

United States Patent [19]

Kuhasalo et al.

[11] Patent Number: 6,101,735

[45] Date of Patent: Aug. 15, 2000

[54] DRYER SECTION IN A PAPER MACHINE IN WHICH IMPINGEMENT AND/OR VENTILATION HOODS ARE USED

[75] Inventors: Antti Kuhasalo, Jyväskylä; Hans Sundqvist, Turku, both of Finland

[73] Assignee: Valmet Corporation, Helsinki, Finland

[21] Appl. No.: 09/064,412

[22] Filed: Apr. 22, 1998

Related U.S. Application Data

[60] Provisional application No. 60/044,983, Apr. 28, 1997.

[30] Foreign Application Priority Data

Apr. 22, 1997 [FR] France ..... 971715

[51] Int. Cl.[7] ..... F26B 11/02

[52] U.S. Cl. ..... 34/117; 34/120; 162/207; 162/359.1

[58] Field of Search ..... 34/114, 115, 116, 34/117, 120, 123, 454, 457, 124; 162/207, 290, 359.1, 375, 358.1, 358.2, 358.5

[56] References Cited

U.S. PATENT DOCUMENTS

| | | | |
|---|---|---|---|
| 3,301,746 | 1/1967 | Sanford et al. | 162/113 |
| 3,418,723 | 12/1968 | Burgess et al. | 34/1 |
| 3,447,247 | 6/1969 | Daane | 34/122 |
| 3,541,697 | 11/1970 | Villalobos | 34/115 |
| 3,816,941 | 6/1974 | Holik et al. | 34/116 |
| 3,956,832 | 5/1976 | Justus | 34/115 |
| 4,033,048 | 7/1977 | Van Ike | 34/92 |
| 4,033,049 | 7/1977 | Schiel et al. | 34/115 |
| 4,064,637 | 12/1977 | Lindgren | 34/122 |
| 5,022,163 | 6/1991 | Ilvespaa et al. | 34/458 |
| 5,279,050 | 1/1994 | Tormanen | 34/117 |
| 5,383,288 | 1/1995 | Ilmarinen | 34/392 |
| 5,495,678 | 3/1996 | Ilmarinen et al. | 34/117 |
| 5,539,999 | 7/1996 | Kuhasalo | 34/455 |
| 5,553,393 | 9/1996 | Korhonen et al. | 34/117 |

FOREIGN PATENT DOCUMENTS

| | | |
|---|---|---|
| 2061976 | 9/1992 | Canada . |
| 0 427 218 B1 | 8/1995 | European Pat. Off. . |
| 57457 | 9/1976 | Finland . |
| 83679 | 3/1991 | Finland . |
| 931263 | 9/1994 | Finland . |
| 22 12 209 | 9/1973 | Germany . |
| 23 64 346 | 7/1975 | Germany . |

OTHER PUBLICATIONS

PCT Application, WO 96/32534, World Intellectual Property Organization, Oct. 1996.

*Primary Examiner*—Pamela A. Wilson
*Attorney, Agent, or Firm*—Steinberg & Raskin, P.C.

[57] ABSTRACT

A dryer section of a paper machine including groups with single-wire draw that include a drying wire guided in a loop and reversing cylinders arranged in the drying-wire loop. Contact drying cylinders are arranged in gaps between the reversing cylinder and the drying wire is guided to press a web against heated faces of the contact drying cylinders. In addition to normal, small-diameter contact drying cylinders, one or more large-diameter contact drying cylinders (the diameter being greater than about 2200 mm and usually in a range from 2200 mm to 3600 mm), is/are used in one or more single-wire draw groups. An impingement-drying/ventilation hood is arranged above the large-diameter contact drying cylinders and extends on a large sector above the contact drying cylinder and above the drying wire and the web running over the cylinder. An impingement-drying/ventilation effect is applied to the drying wire through the impingement-drying/ventilation hoods on the large sector. By means of the effect, a moist boundary layer in contact with the drying wire is disintegrated and drying is promoted from a side of a face of the web opposite to the web face that is placed against the contact drying cylinders.

23 Claims, 6 Drawing Sheets

DRYER SECTION IN A PAPER MACHINE IN WHICH IMPINGEMENT AND/OR VENTILATION HOODS ARE USED

This application claims benefit of Provisional Appl. 60/044,983 filed Apr. 28, 1997.

FIELD OF THE INVENTION

The present invention relates to a dryer section of a paper machine including several groups with single-wire draw, each having a drying wire guided in a loop, contact drying cylinders and reversing cylinders arranged in the drying-wire loop between the contact drying cylinders. The contact-drying cylinders have heated faces and the drying wire presses a paper web to be dried into direct contact with the heated face of each contact drying cylinder on a curve sector greater than about 180°.

BACKGROUND OF THE INVENTION

The highest web speeds in paper machines are today up to an order of about 25 meters per second and slightly higher, but before long, a web running speed in the range of 25–40 meters per second (mps) will be commonly used. In such a case, a bottleneck for the runnability of a paper machine will be the dryer section, whose length with prior art multi-cylinder dryers would also become intolerably long. If it is imagined that a present day multi-cylinder dryer were used in a newsprint machine at a web speed of about 40 mps, it would include about 70 drying cylinders ($\phi \approx 1800$ mm), and its length in the machine direction would be about 180 meters. In such a case, the dryer section would comprise about 15 separate wire groups and a corresponding number of draws over group gaps. It is probable that, in a speed range of 30–40 mps, the runnability of normal prior art multi-cylinder dryers is no longer even nearly satisfactory, but web breaks would occur quite often lowering the efficiency of the paper machine.

In a speed range of 30–40 mps and at higher speeds, the prior art multi-cylinder dryers would also become uneconomical because the cost of investment of an excessively long paper machine hall would become unreasonably high. It can be estimated that the cost of a paper machine hall is at present typically about 1 million FIM per meter in the machine direction.

In the prior art, in multi-cylinder dryers of paper machines, twin-wire draw and/or single-wire draw is/are employed. When employing twin-wire draw, a group of drying cylinders comprises two closed (endless) wires, fabrics or belts which press the web one from above and the other one from below against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls between the drying cylinders, the web remains at the side of the outside curve and is subjected to negative pressure as it runs over the reversing cylinders in order to maintain the web on the wire. Thus, in single-wire draw, the drying cylinders are arranged outside the wire loop, and the reversing cylinders or rolls are arranged inside the wire loop.

It is known to those skilled in the art that if paper is dried one-sidedly, the result is a tendency of curling of the sheet. For example, when paper is dried by means of normal groups with single-wire draw from the side of its bottom face only, the drying is asymmetric and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, when viewed from above.

It is known in the prior art to use various ventilation/impingement-drying/through-drying units for evaporation drying of a paper web, which units have been employed in particular in the drying of tissue paper. With respect to this prior art, reference is made, by way of example, to the following patent literature: U.S. Pat. Nos. 3,301,746, 3,418,723, 3,447,247, 3,541,697, 3,956,832 and 4,033,048, Canadian Patent No. 2,061,976, West German Patent Application Nos. DE-A-22 12 209 (corresponding to U.S. Pat. No. 3,816,941) and DE-A-23 64 346 (corresponding to U.S. Pat. No. 4,033,049), European Patent Application No. EP-A2-0 427 218, Finnish Patent Nos. 83,679, 57,457 (corresponding to Swedish Patent Application No. 7503134-4) and 87,669 (corresponding to U.S. Pat. No. 5,383,288), and Finnish Patent Application No. 931263 (corresponding to U.S. Pat. No. 5,495,678 and European Patent Application No. 0 620 313-A1).

Additionally with respect to the prior art related to the present invention, reference is made to the current assignee's Finnish Patent Application Nos. 913648 (corresponding to U.S. Pat. No. 5,279,050), 940992 (corresponding to U.S. Pat. No. 5,539,999), 941392 (corresponding to U.S. Pat. No. 5,553,393) and 951746. Different dryer section concepts and geometries and impingement-drying units are described in the Finnish Patent Applications mentioned above.

Of the current assignee's Finnish patent applications mentioned above, FI 951746 is most closely related to the present invention. This Finnish patent application describes a dryer-section concept of a paper/board machine, wherein the dryer section comprises a number of drying cylinder groups, which comprise exclusively a single-wire draw, on whose support the web is guided so that it meanders as loop-shaped from a suction cylinder onto a drying cylinder and from the drying cylinder onto a second suction cylinder and therefrom further onto a second drying cylinder. Also, the wire supported the web is guided in connection with the drying cylinders so that the web is placed against the face of the drying cylinder and the wire is placed outside. In connection with the suction cylinders/suction rolls, the wire supporting the web is guided so that, by means of suction, the web is kept in contact with the wire draw, and guided into connection with the second heated drying cylinder. In the dryer-section concept, the web is passed from one drying cylinder group into the next dryer-section group and so on through the dryer section.

In FI 951746, it has been considered a novel feature in the context mentioned above that at least some of the drying cylinders include impingement-drying units or equivalent in connection with them, through which units a heated medium, preferably air or steam, is passed through the wire into connection with the web so as to produce a two-sided drying effect and to increase the drying capacity. Also, the impingement units are situated in the end of the dryer section in an area when the web has such a dry solids content that by means of impingement-drying, it is possible to affect the curling of the web and to prevent it. The impingement-drying units are mounted above contact drying cylinders with normal diameter (ϕ usually about 1800 mm) and it is suggested that the impingement-drying units be placed in the initial end, in the middle area and in the final end of the dryer section. Owing to the matters stated above, the drying concept in FI 951746 cannot achieve the objectives that the present invention aims to achieve, above all because the area of effect of the impingement units cannot be made wide enough if drying cylinders with normal diameters are used and the effect of the impingement-drying units cannot be concentrated on the process stage where their effect would be optimal in view of the objectives of the present invention.

OBJECTS AND SUMMARY OF THE INVENTION

An object of the present invention is to enhance and further develop the above prior art dryer sections in themselves known in view of achieving the objectives to be stated in the following.

A primary object of the present invention is to provide a novel dryer section concept based on evaporation drying, by whose means it is possible to utilize the space in the paper machine hall more efficiently.

Another object of the invention is, in connection with increasing of paper machine speeds and with modernizations, to permit placement of a new dryer section in the place of an existing multi-cylinder dryer.

In relation to this, it is a further object of the invention to provide a dryer section concept that permits ever shorter dryer sections compared with prior art dryer sections.

It is a particular object of the present invention to provide a dryer section in which the removal of broke can take place primarily by the force of gravity and in which so-called inverted wire groups are not used. In inverted groups, the contact drying cylinders are placed in the lower row, the reversing suction cylinders in the upper row and the group is closed towards the bottom so that, in the event of web breaks, the removal of broke must be carried out manually, which is time-consuming and which is also work that is difficult from the point of view of safety at work.

It is a further object of the present invention to provide a dryer section in which it is possible to achieve good runnability and a substantially closed draw of the web and threading of the leader end of the web even without systems of threading ropes.

It is a further object of the invention to make it possible to provide a dryer section concept in which different evaporation devices and techniques can be applied optimally in the different stages of drying so that a short construction of the dryer section, a good quality of the paper and a runnability sufficiently free from disturbance are achieved.

Another important object of the present invention is to provide novel drying modules for a paper web and dryer sections that make use of such modules, which are suitable for use at high web speeds greater than about 25 meters per second, which speeds can be up to an order of from about 30 to about 40 meters per second or even higher.

It is a further object of the present invention to increase the drying capacity by means of ventilation and/or impingement drying and in this way, to make the length of the dryer section shorter, which contributes to an improvement of the runnability of the dryer section.

It is a further object of the invention to provide such a drying method and drying equipment by whose means, in the above-mentioned high speed range, the length of the dryer section in the machine direction can, nevertheless, become reasonable so that its length does not substantially exceed the length of the cylinder dryers currently in operation. An achievement of this objective would permit renewals and modernizations of paper machines in existing paper machine halls up to, and even beyond, a web speed of about 40 meters per second.

It is a further object of the invention to provide a dryer section wherein the web is reliably affixed to the drying wire over substantially the entire length of the dryer section so that cross-direction shrinkage of the web can be substantially prevented and that, thus, cross-direction inhomogeneity in the web arising from an uneven cross-direction shrinkage profile can be avoided.

It is a further object of the present invention to provide a dryer section that permits quick changes of paper grade, and in this way, it is possible to improve the overall efficiency of operation of the machine.

It is a further object of the invention to provide a dryer section in which the removal of broke takes place primarily downward so that the times of breaks and standstills can be reduced and manual handling and disposal of the broke be practically eliminated.

It is a further object of the invention to provide a dryer section which permits profiling of the paper web that is being produced both in the machine direction and in the cross direction in view of producing a paper having a quality as uniform as possible and that complies with the different criteria of quality.

In view of achieving the above objects and others, in accordance with the invention, in addition to normal contact-drying cylinders, one or more contact drying cylinders with a larger diameter, the diameter being greater than about 2200 mm and usually in a range from about 2200 mm to about 3600 mm, is/are used in one or more groups with single-wire draw. Also, an impingement-drying/ventilation hood is arranged above the contact drying cylinder(s) with larger diameter, which hood extends on a considerably large or wide sector above the contact drying cylinder and above the drying wire and the web running over the cylinder. An impingement-drying/ventilation effect is applied to the drying wire through the impingement-drying/ventilation hoods on the wide sector. By means of this effect, the moist boundary layer in contact with the drying wire is disintegrated and drying is promoted from the side of the face of the web opposite to the web face that is placed against the contact drying cylinders.

The invention applies impingement-drying or ventilation by using a ventilation hood, through a drying wire placed on the outer face of a paper web under contact drying on a cylinder with large diameter, which hood can extend over a sufficiently long sector in the machine direction because of the large diameter of the contact drying cylinder concerned. Thus, the large diameter of the contact drying cylinder concerned can be utilized efficiently by means of these impingement-drying/ventilation hoods. By means of the jets of drying gases applied from the hoods and/or air flows in a direction contrary to the running direction of the wire, it is possible to disintegrate the moist boundary layer on the outer face and in the loops of the wire efficiently, and thus it is possible to prevent a growth of the component pressure of water steam in the wire placed on the drying cylinder and thereby to improve the heat-transfer coefficient.

A hood arrangement in accordance with the invention is preferably applied in the final end of the dryer section, where the rate of evaporation tends to become lower and where water which is also present in the fibers is removed. In this connection, the web temperature also rises quite quickly. The invention is preferably applied to the last stage of drying and especially when the three stage method is applied that is described in Finnish Patent Application No. 971714.

The dryer section in accordance with the invention also operates preferably so that in the first stage of the drying, in which the web is mainly heated, the drying effect, preferably a drying effect free of contact, is applied by means of drying gas flows and/or infra radiation on a short section through the upper face of the web. In the following stage, i.e., the main evaporation stage, and/or in the area of decreasing rate of evaporation in the end of the dryer section, the drying effect is applied by means of contact drying cylinders, preferably with the aid of impingement-drying through the lower face of the web. In the final stage, in which also water present in the fibers is removed and the temperature of the web is raised at the same time, the drying effect is applied through both sides of the web, from the lower face with contact drying cylinders and from the upper face with ventilation/impingement-drying hoods in accordance with the invention.

The invention can also be carried into effect so that the dryer section in accordance with the invention comprises one or more groups with single-wire draw, in which group (s), there are contact drying cylinders with larger diameter and contact drying cylinders with smaller diameter alternating with each other, or two successive contact drying cylinders with larger diameter and one contact drying cylinder with smaller diameter alternating with each other. In such a case, the cylinders with smaller diameter are situated on a lower level in the gaps between the cylinders or pairs of cylinders with larger diameter. An impingement-drying/ventilation hood or hoods is/are placed inside the drying-wire loop above the cylinders with larger diameter and possibly also above the cylinders with smaller diameter.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
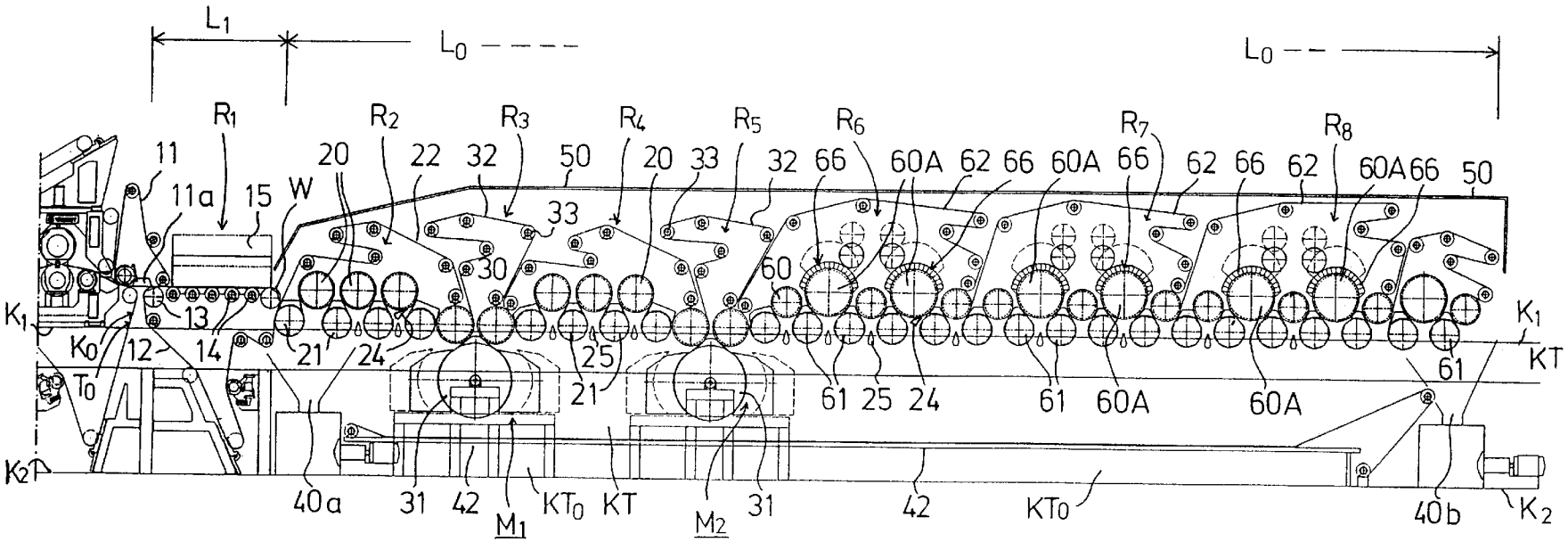
FIG. 1 is a schematic side view of one preferred dryer section in accordance with the invention.

Referring to FIGS. 1–5 wherein like reference numerals refer to the same or similar elements, FIG. 1 shows a particularly preferred overall concept of a dryer section in accordance with the invention. A paper web W is passed from a press section 10 of the paper machine having a dry solids content ko from about 35% to about 60% and a temperature To of from about 30° C. to about 65° C., on the bottom face of a press fabric 11 and supported by a Press-Run™ box 11*a* onto the top face of a drying wire 12 over its guide roll 13. A first planar drying unit $R_1$ comprises a blow hood 15, under which the web W to be dried runs on the horizontal run of the wire 12, which is supported by rolls 14. The horizontal run of the wire 12 forms a plane in connection with which grooved rolls and/or suction boxes or blow boxes support the web W. In the unit $R_1$, an intensive drying energy impulse is applied to the top face of the web W, in which connection, after the unit $R_1$, the temperature $T_1$ of the web W is from about 65° C. to about 85° C. In the unit $R_1$, primarily heating of the web W and the water contained in it take place, but no substantial evaporation of water as yet.

In the unit $R_1$, the paper web W runs on support of the upper run of the drying wire 12 along a substantially linear path in the horizontal plane so that it has no major directional changes in the machine direction and thus, no high dynamic forces are applied to it which might produce a web break in the web W, which is still relatively moist and has a low strength. In the interior of the blow hood 15, there is a nozzle arrangement by whose means hot drying gases, such as air or steam, are blown against the top face of the web W. Additionally or alternatively, it is possible to employ infrared heaters. The blow devices and/or radiators in the unit $R_1$ can be arranged so that their output in the cross direction of the web W is adjustable so as to provide profiling of the web W in the cross direction.

In FIG. 1, the unit $R_1$ is followed by the first so-called normal (not inverted) single-wire unit $R_2$ having a drying wire 22 onto which the web W is transferred as a closed draw in the area of a first reversing suction roll 21. The single-wire unit $R_2$, and so also the subsequent single-wire units $R_4$, $R_6$, $R_7$ and $R_8$ that are open towards the bottom comprise steam-heated contact-drying cylinders 20,60,60A arranged in an upper row and reversing suction rolls 21,61 arranged in a lower row, for example the current assignee's VAC-rolls™. Below the cylinders 20, there are doctors 24,64 and ventilation blow devices 25,65. The paper web W to be dried enters into direct contact with the faces of the steam-heated drying cylinders 20,60,60A, and on the reversing suction rolls 21,61, the web W remains on the drying wire 22 at the side of the outside curve.

In FIG. 1, after the group $R_2$ with single-wire draw, there follows a drying unit $R_3$ which comprises two contact-drying cylinders 30 and a large-diameter $D_1$ impingement-drying/through-drying cylinder 31 with a perforated mantle, which cylinder will be called a large cylinder in the following. A drying wire 32 is guided by guide rolls 33 to run around the contact-drying cylinders 30 and around the large cylinder 31. The impingement-drying/through-drying hood module $M_1$ of the drying unit $R_3$ is situated in a basement space KT underneath the floor level $K_1$—$K_1$ of the paper machine hall on support of the floor level $K_2$—$K_2$ of this space. The central axes of the contact-drying cylinders 30 in the unit $R_3$ and in the corresponding following drying unit $R_5$ in accordance with the present invention are placed substantially in the floor plane of the paper machine hall or in the vicinity of the plane $K_1$—$K_1$, preferably slightly above this plane. The paper web W to be dried is passed from the single-wire unit $R_2$ as a closed draw onto the first drying cylinder 30 in the drying unit $R_3$, after which the web W is passed on the wire 32 of the unit $R_3$ over the large cylinder 31 of the first module $M_1$ on a remarkably large sector greater than about 180° on support of the drying wire 32 and further onto the second drying cylinder 30 in the unit $R_3$. From this drying cylinder 30, the web W is transferred as a closed draw into the next normal unit $R_4$ with single-wire draw, which unit is substantially similar to the unit $R_2$ described above. After this, there follows the second drying unit $R_5$, which unit is similar to the drying unit $R_3$ described above and whose large cylinder 31 is also placed in the basement space KT.

In the basement space, besides the modules $M_1$, $M_2$ and $M_3$, FIG. 1 also shows pulpers 40*a* and 40*b*, between which there is a broke conveyor 41, which carries the paper broke into the pulper 40*a* and/or 40*b*. In the event of a web break, the web W can be passed after the unit $R_1$ directly into the pulper 40*a* placed underneath. The single-wire units $R_2$, $R_4$, $R_6$, $R_7$ and $R_8$ are open towards the bottom, and therefore the paper broke falls from them by the effect of gravity onto the broke conveyor 41 placed underneath or directly into the pulpers 40*a*,40*b*. Also, the modules $M_1$ and $M_2$ are open or openable towards the bottom so that the paper broke falls out of connection with them, substantially by the effect of gravity, without major manual operations, onto the broke conveyor 41 placed underneath.

Underneath the modules $M_1$ and $M_2$, above the floor level $K_2$—$K_2$ of the basement space KT, there is still space KTo for various devices, such as ducts through which the heating medium, such as heated air or steam, is passed into the interior of the hoods 35 of the modules $M_1$ and $M_2$ and also into hoods 66 of cylinders 60A of the units $R_6$, $R_7$ and $R_8$. The lower space KTo is defined from below by the floor level $K_2$—$K_2$ of the basement space and from above by a partition wall 42 placed below the broke conveyor 41. On the drying units $R_2, \ldots, R_8$, there is an air-conditioned hood 50 in itself known.

Additional details of the construction of the impingement-drying hood modules $M_1$ and $M_2$, shown in FIG. 1 is described in the current assignee's Finnish Patent Application No. 971713. Additionally, the method in accordance with FIG. 1 preferably applies the three-stage drying method described in the current assignee's Finnish Patent Application No. 971714. In this case, the stage I of the latter Finnish patent application is carried out by the unit $R_1$, the stage II by the units $R_2$, $R_3$, $R_4$, $R_5$, $R_6$ and the stage III by the special units $R_7$, $R_8$ or by the last special unit $R_8$ only.

Figure 2:
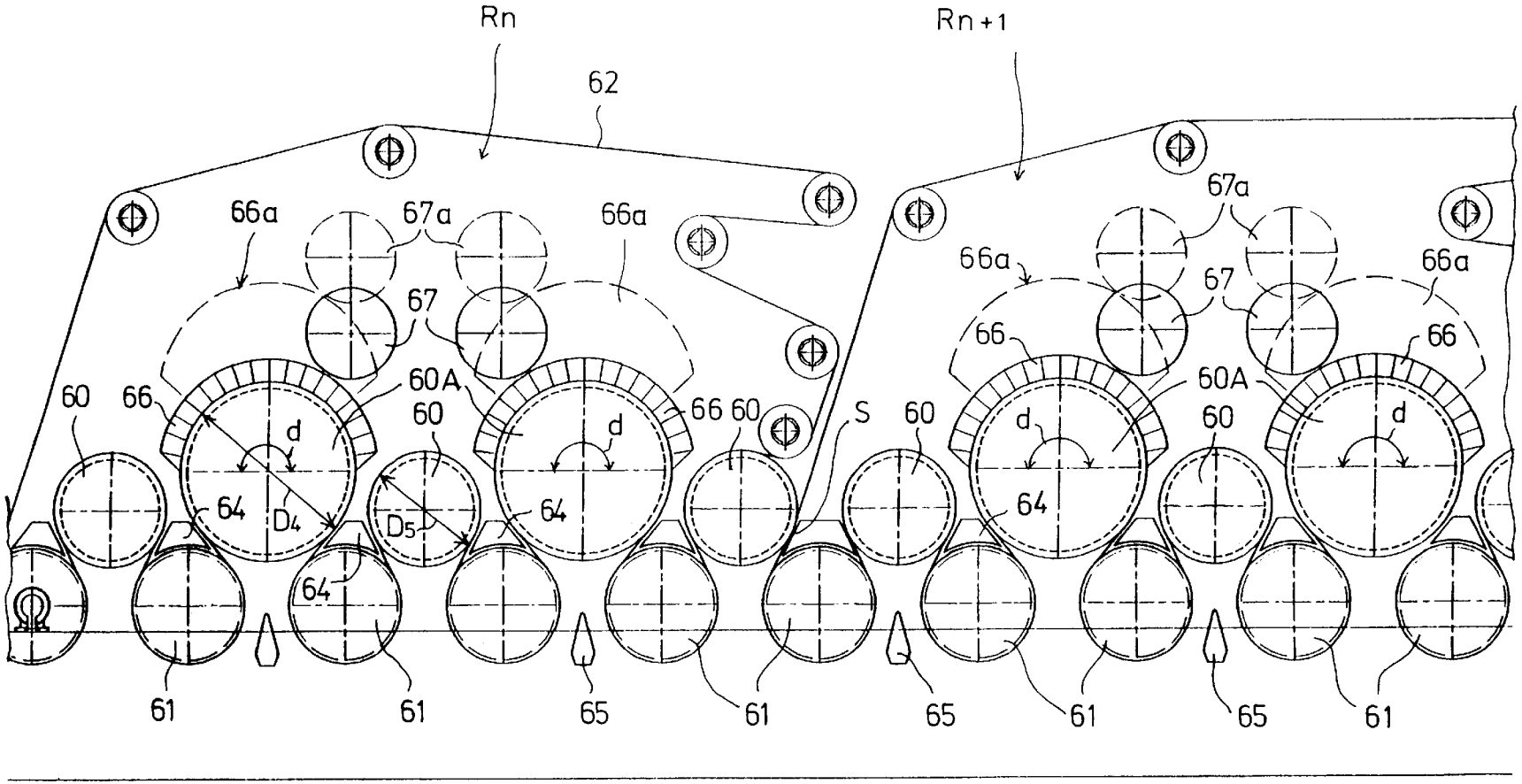
FIG. 2 shows two groups with single-wire draw applicable in the invention and the closed draw over the group gap between these groups, in a scale larger than FIG. 1.

FIG. 2 shows two successive groups with single-wire draw $R_n$ and $R_{n+1}$ to be applied in the invention and the closed draw S of the web W between these groups. The paper web W to be dried is brought as a closed draw to the group $R_n$ from the preceding group (not illustrated). There are five reversing suction cylinders 61 situated inside the wire loop 62 in the groups $R_n$ and $R_{n+1}$. The groups $R_n$ and $R_{n+1}$ include five contact drying cylinders 60,60A. Two middle or intermediate ones 60A of these cylinders are contact drying cylinders with a diameter larger than that of the other cylinders 60, and their diameter is $D_4$ greater than about 2200 mm, typically in a range from about 2200 mm to about 3000 mm (in FIG. 2, $D_4$=about 2350 mm and $D_5$=about 1500 mm), whereas the diameter $D_5$ of the smaller cylinders 60 is from about 1300 mm to about 1800 mm and the diameter $D_6$ of the reversing suction cylinders 61 is from about 600 mm to about 1500 mm. In order that a significant advantage could be achieved over the prior art constructions with an arrangement in accordance with the invention, the diameter $D_4$ should be greater than $1.2 \times D_5$. In the gaps between the reversing suction cylinders 61, there are blowing devices 65 for ventilation of the spaces between the cylinders 60,60A and 61 and also for promoting the drying. The upper sector free from the web W and the wire 62 on the reversing suction cylinders 61 is covered with a blocking part 64 which promotes the maintenance of the vacuum produced inside the cylinders 61.

In order that the objectives of the invention may be achieved by means of the special groups $R_n$ and $R_{n+1}$ shown in FIG. 2 and that a sufficiently high evaporation efficiency and an adequate increase in the web W temperature may be obtained, a drying effect is applied to the web W on the contact drying cylinders 60A of large diameter ($D_4$>2200 mm) also from the top face of the web W, i.e., from the side of the drying wire 62. For this purpose, impingement-drying/ventilation hoods 66 are mounted above the cylinders 60A of large diameter $D_4$, into which hoods ventilation/drying gases are passed through an intake pipe 67. The humid ventilation air is discharged from the pressurized interiors of the ventilation hoods 66 into a hood 50 that surrounds the dryer section, from which hood the air is removed in a way known from the prior art. These drying gases are blown against the drying wire 62 on the sector d of the cylinders 60A, this sector being preferably about 180° or even larger. In this manner, evaporation of water through the upper face of the web W through the wire 62 is promoted. The ventilation hoods 66 are shown in their open position 66*a* and so also their air intake pipes are shown in their open position 67*a*. In the open position 66*a*, it is possible to clean and service the ventilation hoods, and the web W threading can also be carried out most favorably.

Figure 3:
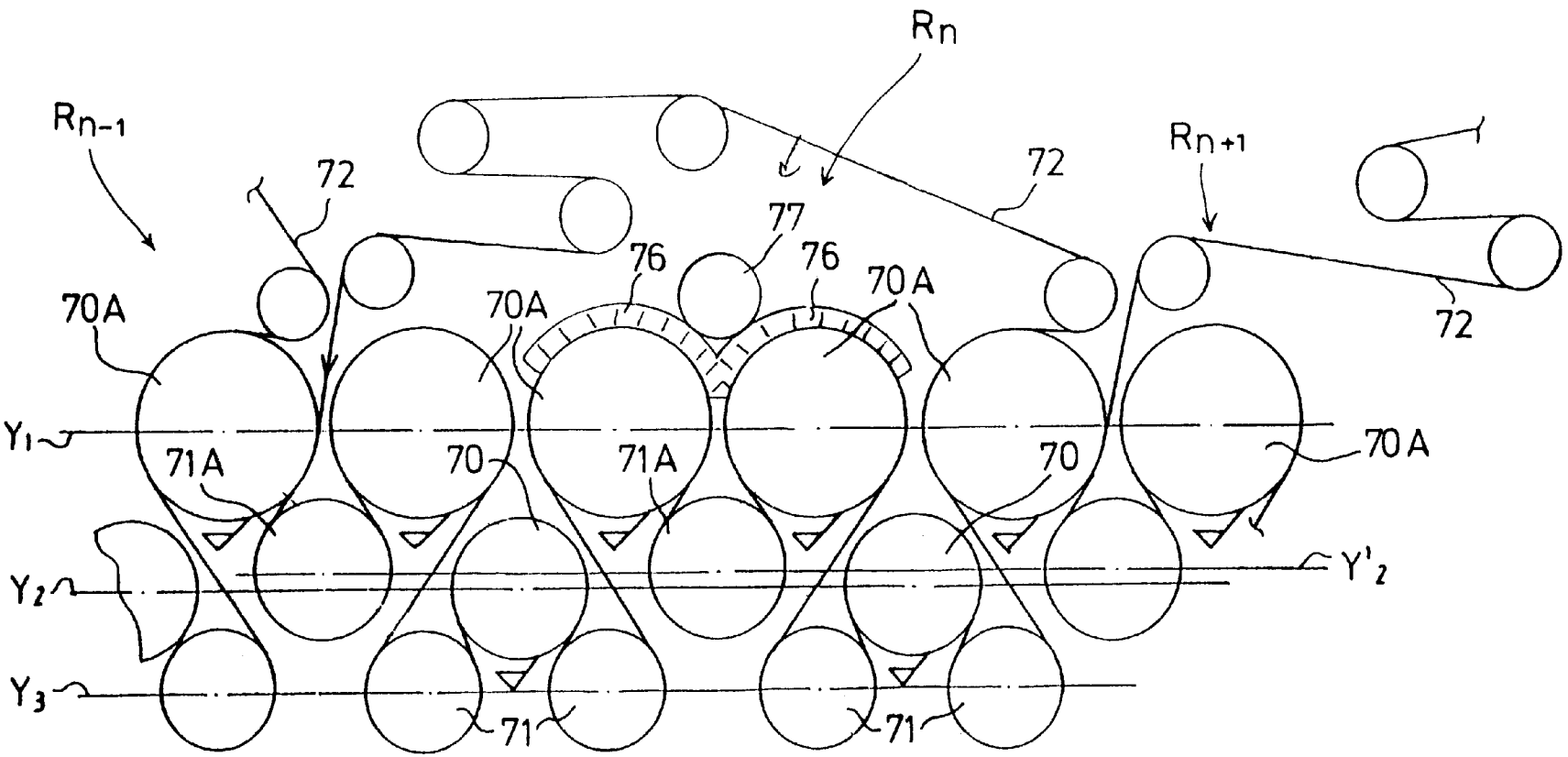
FIG. 3 shows a wire group applicable in the invention in which drying and reversing cylinders are used that are placed on four horizontal levels, one level above the other.
Figure 4:
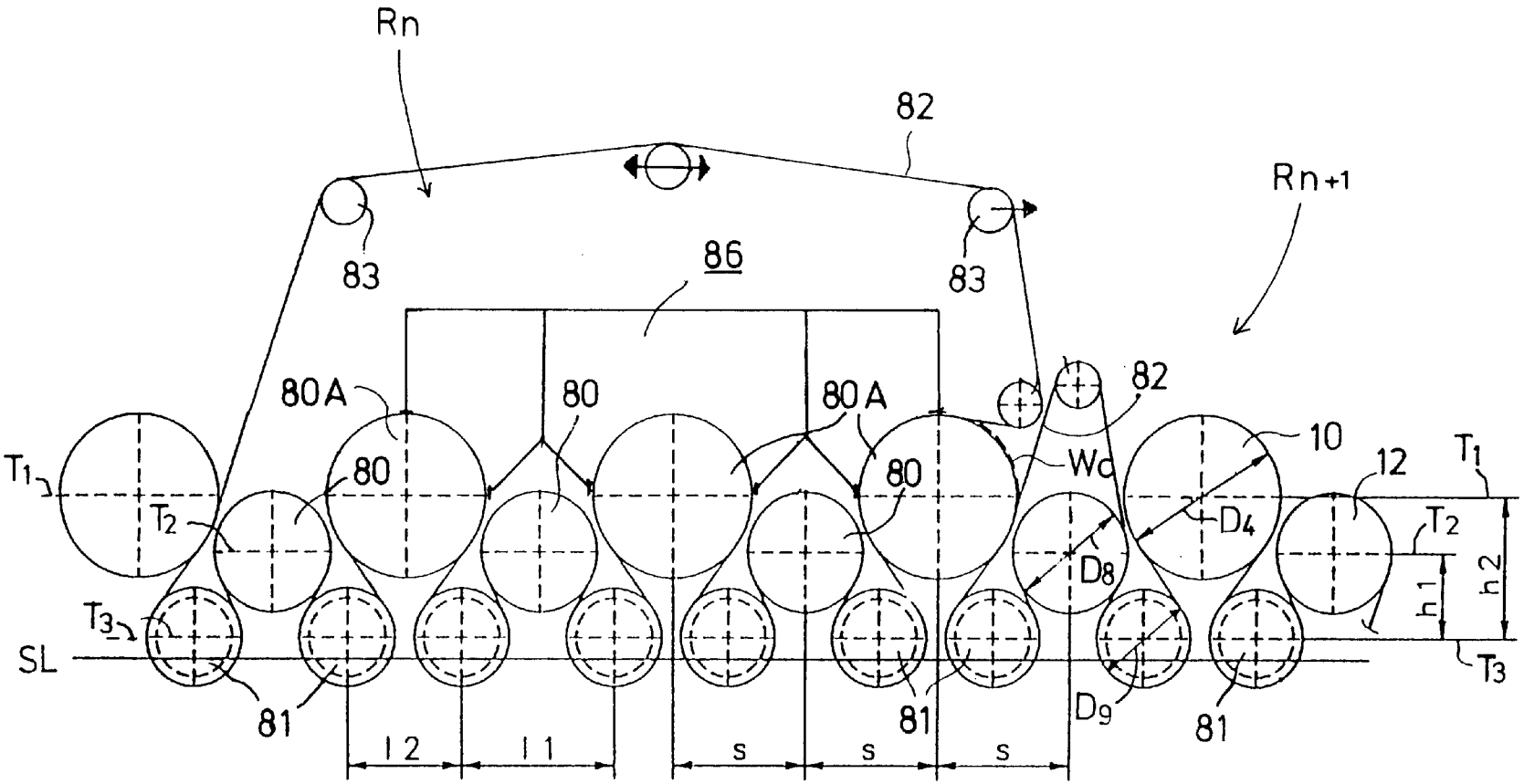
FIG. 4 shows a group with single-wire draw applicable in the invention in which contact drying cylinders of small diameter and large diameter are used that are placed alternatingly in the gaps between the cylinders.
Figure 5:
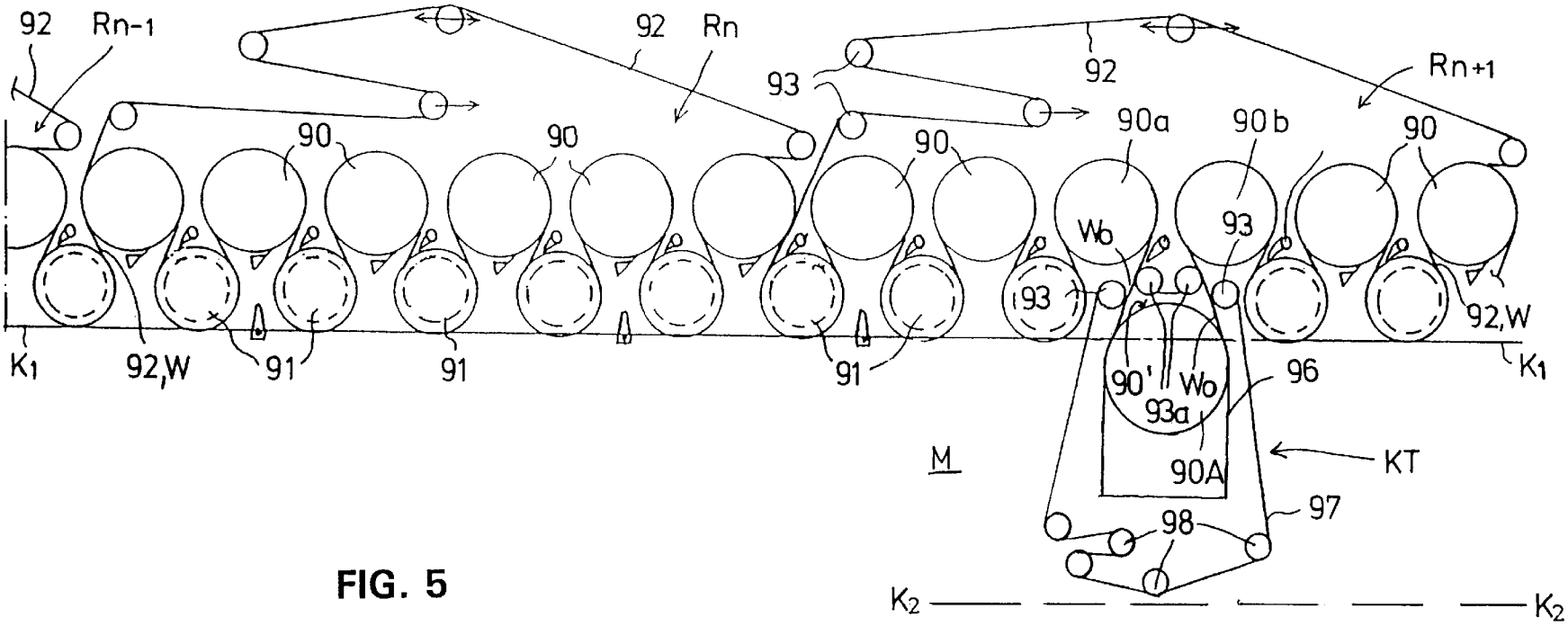
FIG. 5 shows an embodiment of the invention in which, in one cylinder group, a drying cylinder with large diameter is used together with a wire group that is provided with an impingement hood arranged in accordance with the invention.

In the invention, by means of the special groups $R_n$ and $R_{n+1}$ and other equivalent special groups, to be described in relation to FIGS. 3–5, it is possible to carry out double-sided application of drying energy and an intensified evaporation from the web W, especially in the final stage of the drying.

If the hoods 66 illustrated in FIG. 2 are, in accordance with the invention, impingement-drying hoods, they have a perforated nozzle face corresponding to the curve form of the large cylinder 60A, from which nozzle face drying gases are blown with the velocity $v_g$ of greater than about 60 m/s, the gas temperature T being in the range of from about 100° C. to about 300° C. The blow velocity is generally in the range of from about 60 m/s to about 140 m/s. When impingement-drying is used, the moistened drying gases are removed, for example, using the kind of a circulation arrangement that is illustrated in FIG. 3 of the current assignee's Finnish Pat. Appl. No. 971713. On the other hand, if the hoods 66 operate as ventilation hoods, the moistened drying gases are allowed to be discharged from the edges of the hood into the interior of the hood 50 of the dryer section, from where they are removed in a way in itself known. When a ventilation hood is used, the velocity of the drying gases is preferably in a range of from about 40 m/s to about 120 m/s, and the temperature T of the drying gases is in a range from about 20° C. to about 200° C. The hoods 66 and the equivalent hoods 76,86,96 shown in FIGS. 3–5 can be divided into segments by means of vertical walls placed in the machine direction, into which segments, different drying gases can be passed for profiling the web W in the cross direction.

With respect to the hood constructions and the heating and circulation equipment of the ventilation/impingement-drying gases in connection with the hoods, reference is made to the current assignee's Finnish Patent Application No. 951746 and especially to the embodiments illustrated in FIGS. 4A, 4B, 4C and 5 of this application (reproducing these embodiments not being considered necessary herein).

The single-wire groups $R_n$ and $R_{n+1}$ illustrated in FIG. 2 are preferably applied in the final part of the dryer section so that group $R_{n+1}$ is, for example, the last group in the dryer section, in which the method stage that is described in the last stage III in the current assignee's Finnish Patent Application No. 971714 is applied. In such a method stage, the web W is dried highly efficiently and double-sidedly by means of the cylinders 60 and 60A as contact drying from the lower side, and from the upper side drying and evaporation efficiency are promoted by means of efficient impingement-drying/ventilation hoods 66 above the large cylinder 60A. Hoods 66 act on a sufficiently large sector d above the large cylinders 60A and apply a drying effect to the web W also through its upper face. In this manner, a double-sided, efficient drying is achieved in the last stage of drying, in which water is also removed from inside the fibers in the web W, which requires more than an average amount of drying energy. At the same time, it is possible to reduce the curl caused by one-sided contact drying.

With respect to the different details of construction and operation of the hoods 66, reference is additionally made to the prior art disclosed in the current assignee's Finnish Patent Application No. 951746 and in Finnish Patent No. 83,679 to Teollisuusmittaus Oy.

FIG. 3 shows three successive dryer groups $R_{n-1}$, $R_n$, $R_{n+1}$, which are special groups with single-wire draw and open towards the bottom, additional details of which are described in the current assignee's Finnish Patent Application No. 971713. FIG. 3 shows a grouping between heated drying cylinders 70A and 70 and cold cylinders 71A and 71, i.e., reversing rolls. As shown in FIG. 3, each dryer group is composed of a group of cylinders in which the heated drying cylinders 70A, 70 are placed on two levels, the levels $Y_1$ and $Y_2$. The reversing cylinders 71A are placed on the level $Y'_2$ and the reversing cylinders 71 are placed on the level $Y_3$. The heated drying cylinders 70 placed on the middle level $Y_2$ have a smaller diameter than the drying cylinder 70A placed on the level $Y_1$.

Together with the wire 72, the paper web W is brought onto the drying cylinder 70A on the level $Y_1$ from the reversing cylinder 71A on the level $Y'_2$. From the drying cylinder 70A, the web W is passed onto the reversing cylinder 71A and from there further, together with the wire 72, to the middle heated drying cylinder 70. From the middle heated drying cylinder 70, the paper web W and the wire 72 are passed onto the second reversing cylinder 71 on the level $Y_3$. From the reversing cylinder 71, the paper web W is passed onto the second heated drying cylinder 70A with a larger diameter on the level $Y_1$, from where the web W is passed onto the reversing cylinder 71A on the level $Y'_2$. In a corresponding manner, the wire 72 is passed from one cylinder onto another. The paper web W runs against the faces of the drying cylinders on the heated drying cylinders 70A and 70. On the reversing cylinders 71A and 71, the paper web W runs on the outside and the wire 72 runs against the face of the cylinder. The reversing cylinders 71 are placed symmetrically at the same distance from the vertical plane drawn through the center of the heated drying cylinder 70 of smaller diameter. The heated drying cylinders 70A of larger diameter ($D_4$>2200) mm are also placed symmetrically at the same distance from the vertical plane. In a corresponding manner, the reversing cylinders 71A of the level $Y'_2$ are placed symmetrically to the vertical center plane and at the same distance from it.

In FIG. 3, in the group $R_n$, a ventilation/impingement-drying hood 76 is arranged above the drying cylinders 70A of larger diameter, which hood extends over the cylinders 70A of large diameter ($D_4$>2200 mm) on a considerably large sector in order to apply the drying effect to the web W from the side of the drying wire 72, i.e. through the upper face of the web W while the web is on the cylinders 70A subject to a direct contact drying by the contact drying cylinders through its lower face. In FIG. 3, the hood 76 is arranged above two middle cylinders 70A in the group $R_n$, but it can be extended to cover several or all of the cylinders 70A in the group $R_n$. The air intake pipe of the hood 76 is denoted by reference numeral 77.

The two successive wire groups $R_n$ and $R_{n+1}$ shown in FIG. 4 are in most other respects substantially similar to prior art normal (non-inverted) dryer groups except that the dryer section comprises contact drying cylinders 80A and 80 having two different diameters $D_4$ and $D_8$, which cylinders are placed in a very compact arrangement alternatingly. Large cylinders 80A with larger diameter $D_4$ (which is greater than about 2200 mm and generally from about 2200 mm to about 3600 mm), are placed on the highest level T1 and the small cylinders 80 with smaller diameter $D_8$ are placed on a lower level T2, the difference in height between these levels T1–T2 being h2–h1. Reversing cylinders 81 are placed between the drying cylinders 80, 80A on a level T3 substantially lower than the levels T1 and T2. The paper web W to be dried runs through the dryer groups $R_n$, $R_{+1}$ supported by the drying wires 82, guided by leading rolls 83, so that on the reversing cylinders 81, the web W remains at the outside curve. On the drying cylinders 80,80A, the web W is pressed by the drying wire 82 into a direct and immediate contact with the heated face of the drying cylinders 80,80A. The diameters of the large cylinders 80A, the small cylinders 80 and the reversing cylinders 81 are selected such that $D_4>D_8>D_9$.

FIG. 4 shows a wide impingement-drying/ventilation hood 86 arranged inside the loop of the drying wire 82, which hood extends above all large cylinders 80A in the group $R_n$. The hood 86 extends on the first large cylinder 80A onto its sector whose magnitude is about 90°, on the middle large cylinder 80A onto a sector whose magnitude is about 180°, and on the last large cylinder 80A onto a sector, whose magnitude is also about 90°. In this way, also taking into consideration the large diameter ($D_4$>2200 mm) of the large cylinders 80A, a sufficiently wide impingement-drying/ventilation effect can be achieved through the wire 82 in order to enhance the drying taking place from the upper surface of the web W in the way described above and in accordance with the present invention.

In accordance with the embodiment shown in FIG. 4, it is possible to provide a particularly compact dryer section so that substantially more "hot coverage" than in prior art dryer groups is obtained per meter of horizontal length of the dryer section in the machine direction. This can be achieved in view of the fact that by means of the drying cylinders 80,80A, cover sectors larger than previously used can be obtained. The cover sectors are typically in the range of from about 220° to about 260°.

In the exemplifying embodiment shown in FIG. 4, there is a small cylinder 80 (smaller A) diameter $D_8$) as the first cylinder in each wire group $R_n$, $R_{n+1}$, . . . , and a large cylinder 80A (larger diameter $D_4$) as the last cylinder. On a free sector of the large cylinder 80A, the web W is transferred as a closed draw WC onto the wire 82 of the next group and further, onto the first reversing cylinder 81. In FIG. 4, the horizontal spacing of the reversing cylinders 81 placed at both sides of the small cylinders 80 is $1_1$, and the spacing of the reversing cylinders 81 placed at both sides of the large cylinders 80A is $1_2$ and $1_1>1_2$. The horizontal spacing between the large and small cylinders 80A,80 is uniform spacing s both within a group and in group gaps between groups $R_n$, $R_{n+1}$ in which a closed draw WC is preferably applied. In group gaps, the spacing can also be different from the above.

Figure 4A:
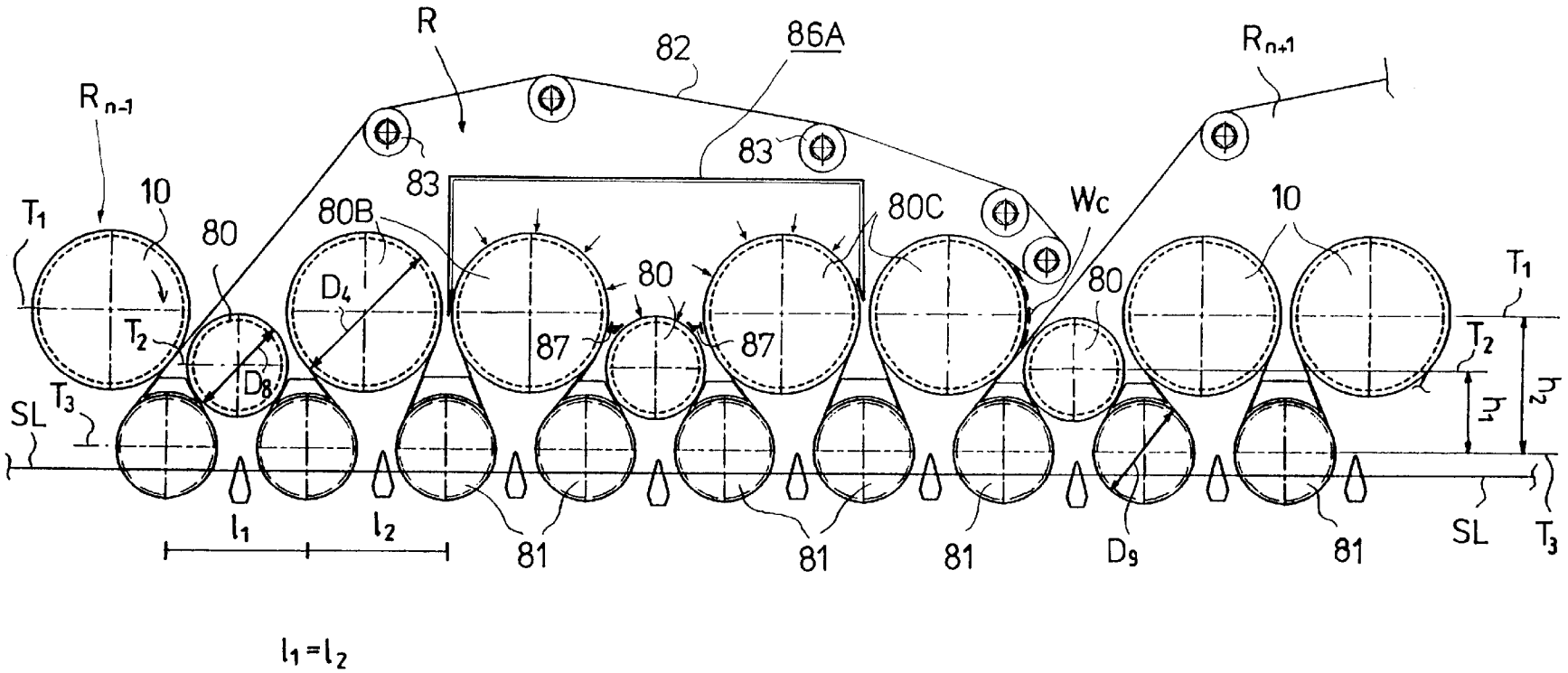
FIG. 4A shows a variation and modification of the group with single-wire draw as shown in FIG. 4 in which there are, arranged alternatingly as interlocking with each other, pairs of contact drying cylinders with large diameter as well as contact drying cylinders with small diameter.

FIG. 4A shows a modification and variation of the group with single-wire draw described above in relation to FIG. 4. In the following, mainly just the features of the group $R_1$, with single-wire draw shown in FIG. 4A will be described that differ from those described above in relation to FIG. 4, because the other constructions, measures, and operational properties are similar to those described above in relation to FIG. 4. In the group $R_1$, shown in FIG. 4A, placed one after the other, there is a pair of drying cylinders 80B with larger diameter $D_4$, which pair is preceded and followed by a contact drying cylinder 80 with smaller diameter $D_8$. The latter cylinder 80 with smaller diameter is again followed by a pair of drying cylinders 80C with larger diameter. In the gaps between the cylinders 80,80B,80,80C, on the lowest level T3, there are reversing suction cylinders 81 as described in relation to FIG. 4. The particular features and advantages of the cylinder geometry of a group $R_n$ with single-wire draw as shown in FIG. 4A are described in more detail in the current assignee's Finnish Patent Application No. 971655.

As shown in FIG. 4A, inside the wire loop 82 of the group $R_n$ with single-wire draw, a through-drying hood 86A for blowing through the wire is provided. This hood 86A extends to covers the latter cylinder in the pair of cylinders 80B and the former cylinder in the pair of cylinders 80C as well as the cylinder 80 with smaller diameter $D_8$ placed between these larger cylinders. The hood 86A extends over the adjacent cylinders 80B and 80C on a sector of about 180°, and over the smaller cylinder 80 placed between these cylinders on a sector of about 90°. The latter covering sector on the cylinder 80 is defined by the lower walls 87 of the hood 86A, which walls are placed in the intermediate spaces between the cylinders 80B, 80 and 80C. The cross-direction edges and the machine-direction end edges of the hood 86A are provided with sufficiently small gaps in relation to the drying wire 82 in order to minimize escaping of the drying air. By means of the hood 86A, through-drying of the web W by blowing through the drying wire 82 is carried out in the manner described above.

FIG. 5 shows an embodiment of the invention in which there is closed draw between the successive normal groups $R_{n-1}$, $R_n$ and $R_{n+1}$. A drying module M applying the invention is situated inside the latter normal group $R_{n+1}$, which module comprises a large cylinder 90A having a heated face 90' against which a face of the web W, opposite to the face placed against the drying cylinders 90 in normal groups Rn, is pressed. The web W comes from the drying cylinder 90 of the normal group $R_{n+1}$ as a short open draw WO to the large cylinder 90A and moves from the large cylinder 90A correspondingly as a short open draw WO to the drying wire 92 of the group $R_{n+1}$ at a leading roll 93*a* and from there further to the drying cylinder 90*b*, continuing through the group $R_{n+1}$ supported by the same drying wire 92. In addition to the drying module M situated inside the normal group $R_{+1}$, it is possible to use a drying module similar to that shown in FIG. 5 in the group gaps between the normal groups $R_{n-1}$,$R_n$ and $R_{n+1}$. In connection with a drying module M arranged inside a normal group $R_{n+1}$, it is, naturally, also possible to use a closed draw of the web W without an open gap.

A wire 97 that is placed outside the module M is arranged in connection with the large cylinder 90A, which wire is guided by leading rolls 93 and 98. The outer wire 97 presses the web W to be dried against the heated face of the large cylinder 90A. An impingement-drying/ventilation hood 96 is arranged in accordance with the invention, inside the loop of the outer wire 97. Hood 96 extends on the large cylinder 90A over a sector of about 180° so that the area of effect of impingement-drying/ventilation blowing can be made large enough in view of the objectives of the invention. This is achieved partly thereby that the diameter $D_4$ of the large cylinder 90A is selected to be greater than about 2200 mm, preferably $D_4$ is from about 2200 mm to about 3600 mm.

In the module M, the effect of the impingement-drying/ventilation hood 96 is applied to the web W through its lower face in connection with the wire 97 and through the wire, contrary to the hoods 66,76,86,86A shown in FIGS. 1–4 and 4A. On the other hand, the large cylinder 90 dries the web W by contact drying through its upper face.

In FIG. 5, the module M and its hood 96 are placed in the basement space KT underneath the floor level K1—K1 of the paper machine hall, above the floor level K2—K2 of the space KT. There are no broke removal problems in a drying module M in accordance with FIG. 5, because the outer wire 97 prevents access of shreds of paper broke to the nozzle face (not illustrated) in the hood 96.

In respect of the construction of the impingement-drying/ventilation hoods 66,76,86,86A,96 and the related air circulation arrangements, reference is made, by way of example, to Finnish Patent Application No. 971713, and especially to FIG. 3 therein. The hood (35), its nozzle face (60), its nozzle perforations (61), and the air circulation arrangements (A1–A9, 65–67) and cross-direction profiling arrangements of the web W (m1, . . . , mN, Am1, . . . , AmN, 35k), illustrated in FIG. 3, can be applied, as modified if necessary, also with the present invention, taking into account the preferred dimensioning and operating parameters and arrangements of equipment suggested herein.

The temperature of the blowing air in the hoods 66,76, 86,96 is in impingement-drying from about 100° C. to about 200° C. and in a ventilation hood from about 20° C. to about 200° C. The rate of blowing is selected in impingement-drying in a range of from about 60 meters per second to about 140 meters per second and in the ventilation hood, in the range from about 40 meters per second to about 120 meters per second. The distance from the nozzle face to the web W or wire 62,72,82,92 is dimensioned in the range of from about 10 mm to about 50 mm, preferably in the range from about 20 mm to about 30 mm. The diameter of the nozzle holes is from about 3 mm to about 10 mm, preferably from about 4 mm to about 6 mm. The proportion of open area of the blow nozzles in the nozzle face is dimensioned in the range from about 0.5% about 5%, preferably in the range from about 0.5% to about 2%.

The air system of the hoods 66,76,86,86A,96 can be one of the following systems (1), (2) or (3) depending on the temperature level applied, on the amount of blowing air, or on the location in the dryer section:

(1) A separate air circulation arrangement, in which recirculated air is sucked from the impingement-drying/ventilation hoods 66,76,86,86A,96, from which air the water evaporated from the area of the hood 66,76,86,86A,96 is removed by means of a certain exhaust air flow, and to which air compensation air and/or combustion air, depending on the method of heating, is added in order to maintain the air balance. In this arrangement, the hoods 66,76,86,86A,96 comprise a return air space connected with the return air side of the circulation air system, into which return air space, the blowing air used in drying and the water evaporated in drying are drawn.

(2) An air circulation arrangement, where the air needed for blowing is mainly taken from the closed hood 50 covering the dryer section. Compensation air, which can be pre-heated, can be mixed with this air in order to lower the humidity of the air. Heating of either blowing air or compensation air is used to reach the correct temperature level of the blowing air. In this case, the evaporated water is discharged along with the used drying air into the closed hood 50 and is carried out along with the exhaust air flow. One alternative is a solution in which the blowing air taken from the closed hood 50 is drawn from a point that is close to the impingement-drying/ventilation hoods 66,76,86,86A, 96 and, thus, a certain air circulation arrangement is provided, even though there is no return air space proper in the hoods, and in this manner, a better energy efficiency can be achieved.

(3) Direct blowing-air arrangement, in which the drying air is taken from outside the dryer section and heated.

The air devices can be placed outside the hoods proper or be partly or totally integrated with the impingement-drying/ventilation hoods 66,76,86,86A,96 proper. Depending on the temperature level applied, on the amount of blowing air, on the location in the dryer section, or on the energy cost level of the mill and on the availability of different fuels, the heating of the blow air for the hoods 66,76,86,86A,96 can be carried out by one of the following methods or by combinations of the methods: by means of a gas burner either directly in the drying air flow or in a heat exchanger system; by means of an oil burner either directly in the drying air flow or in a heat exchanger system; by means of steam radiators or electric radiators.

In the starting and heating phase of the hood system, in the event of a web break, during threading and in a maintenance and cleaning situation, the hoods 66,76,86,86A,96 are preferably arranged to be moved to a larger distance from the web W or wire 62,72,82,92, which makes working and surveillance of the web W or its leader end easier and reduces the heat load caused by the hot nozzle face on the bare wire or cylinder faces.

In the starting and heating phase of the hood system, in the event of a web break and during threading, the air circulation arrangement based on use of gas or oil burners operates with a so-called short circulation. In the short circulation, blowing of hot blowing air directly onto bare wire or cylinder faces is prevented by directing the circulation air through a bypass duct straight into the return air duct. In such a case, the burner does not have to be turned off, for example, in a break situation, which would require a new, rather long starting sequence.

In a way in itself known, impingement-drying/ventilation hoods 66,76,86,86A,96 arranged in accordance with the invention can also be used to regulate the cross direction moisture profile of the web W by dividing the hoods in cross direction into different blocks, so that it is possible to pass a drying gas of adjustable state into each block.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. In a dryer section of a paper machine having single-wire draw groups, each of said single-wire draw groups including a drying wire guided in a loop, reversing cylinders arranged in said drying-wire loop and small-diameter contact drying cylinders each arranged in a gap between a pair of said reversing cylinders, a paper web being pressed by said drying wire into direct contact with said small-diameter contact drying cylinders, the improvement comprising:

at least one large-diameter contact drying cylinder having a diameter greater than about 2200 mm arranged in at least one of said single-wire draw groups, the web being pressed by said drying wire of said at least one of said single-wire draw groups into direct contact with said at least one large-diameter contact drying cylinder, the diameter of each of said at least one large-diameter contact drying cylinder being greater than a diameter of said small-diameter contact drying cylinders in said at least one single-wire draw group, and an impingement-drying hood arranged to extend over a curve sector of said at least one large-diameter contact drying cylinder along which the web and said drying wire of a respective one of said at least one of said single-wire draw groups run, said hood being arranged to apply an impingement-drying effect to the web and said drying wire on said curve sector of said at least one large-diameter contact drying cylinder such that a moist boundary layer in contact with said drying wire is disintegrated and drying is promoted from a side of a face of the web opposite to the face of the web contacting said at least one large-diameter contact drying cylinder.

2. The dryer section of claim 1, wherein each of said at least one large-diameter contact drying cylinder has a diameter in a range from 2200 mm to about 3600 mm and in each of said at least one single-wire draw groups, said drying wire is arranged to press the web into direct contact with heated faces of said small-diameter contact drying cylinders over a curve sector of about 180°.

3. The dryer section of claim 1, wherein said at least one of said single-wire draw groups including said at least one large-diameter contact drying cylinder is arranged in a final end of the dryer section in the area in which a last stage of evaporation drying of the web is carried out such that by means of said hood, water present in fibers in the web is evaporated while the drying efficiency of the dryer section is lowered and the web temperature rises as the drying proceeds and approaches the end of the dryer section.

4. The dryer section of claim 1, wherein said hood is arranged such that said curve sector of said at least one large-diameter contact drying cylinder over which said hood extends is greater than about 180°.

5. The dryer section of claim 1, wherein said small-diameter contact drying cylinders in said at least one of said single-wire draw groups are arranged in a first row and said reversing cylinders are arranged in a second row below said first row such that said at least one of said single-wire draw groups is open toward the bottom and constitutes a normal group, said at least one large-diameter contact drying cylinder comprising at least two of said large-diameter contact drying cylinder, each said large-diameter contact drying cylinder extending below a respective hood, one of said small-diameter contact drying cylinders being arranged on each side of each of said large-diameter contact drying cylinders, said reversing cylinders being arranged below said small-diameter cylinders and each said large-diameter contact drying cylinder.

6. The dryer section of claim 1, wherein said hood is arranged to employ impingement drying and includes a nozzle face having perforations and means for directing drying gas through said perforations at a velocity greater than about 60 m/s and at a temperature from about 100° C. to about 300° C.

7. The dryer section of claim 1, wherein said hood is arranged as a ventilation hood and includes a nozzle face having perforations and means for directing ventilation gases through said perforations at a velocity between about 40 m/s and about 120 m/s and at a temperature from about 20° C. to about 200° C.

8. The dryer section of claim 1, further comprising a first dryer group in the dryer section arranged before said single-wire draw groups in a running direction of the web, said first dryer group comprising a drying wire guided in a loop and adapted to receive the web from a press section preceding the dryer section and carry the web in a run, and means arranged above said run of said drying wire for applying at least one of drying gases and drying radiation to the web without contacting the web;

a first one of said single-wire draw groups being arranged after said first dryer group, at least a first drying module arranged after said first of said single wire draw groups, said first drying module comprising a drying wire guided in a loop, a large-diameter impingement drying cylinder arranged in said loop of said drying wire, said drying wire being guided over said large-diameter cylinder such that a contact sector of said drying wire over said large-diameter cylinder is greater than about 180°, a blow hood arranged around said large-diameter cylinder and having an open position and a closed position, and a pair of smooth-faced heated contact-drying cylinders having a diameter smaller than a diameter of said large-diameter cylinder, each of said pair of contact-drying cylinders being situated on a respective side of said large-diameter cylinder at least one of above said large-diameter cylinder and proximate said large-diameter cylinder; and said at least one of said single wire draw groups including said at least one large-diameter contact drying cylinder being arranged after said first drying module.

9. The dryer section of claim 8, wherein said at least one of said single wire draw groups including said at least one large-diameter contact drying cylinder arranged after said first drying module comprises a plurality of single-wire draw groups including said at least one large-diameter contact drying cylinder.

10. The dryer section of claim 1, further comprising a drying module comprising a drying wire guided in a loop, a large-diameter impingement drying cylinder arranged in said loop of said drying wire and below the floor level of the paper machine hall, said drying wire being guided over said large-diameter cylinder such that a contact sector of said drying wire over said large-diameter cylinder is greater than about 180°, a blow hood arranged around said large-diameter cylinder and having an open position and a closed position, said blow hood being situated at least partially below the floor level of the machine hall, and a pair of smooth-faced heated contact-drying cylinders having a diameter smaller than a diameter of said large-diameter cylinder, each of said pair of contact-drying cylinders being situated on a respective side of said large-diameter cylinder at least one of above said large-diameter cylinder and proximate said large-diameter cylinder, said contact-drying cylinders having a respective central axis situated above the floor level of the paper machine hall.

11. The dryer section of claim 10, further comprising a broke conveyor arranged underneath said hood such that the removal of broke from said hood takes place by the force of gravity onto said broke conveyor.

12. The dryer section of claim 1, wherein said at least one large-diameter contact drying cylinder comprises a plurality of large-diameter contact drying cylinders arranged at a first level, said small-diameter contact drying cylinders being arranged at a second level below said first level of large-diameter contact drying cylinders and one of said small-diameter contact drying cylinders being arranged between an adjacent pair of said large-diameter contact drying cylinders, one of said reversing cylinders being arranged between each adjacent pair of said contact drying cylinders and at a third level below said second level of small-diameter contact drying cylinders, said hood being arranged inside said loop of said drying wire above said one of said small-diameter contact drying cylinders.

13. The dryer section of claim 12, wherein one of said small-diameter contact drying cylinders is arranged between each adjacent pair of said large-diameter contact drying cylinders such that said small-diameter contact drying cylinders and said large-diameter contact drying cylinder alternate with each other.

14. The dryer section of claim 12, wherein at least two pair of said large-diameter contact drying cylinders are arranged such that said large-diameter contact drying cylinders in each pair are adjacent one another without the interposition of one of said small-diameter contact drying cylinders therebetween, said one of said small-diameter contact drying cylinders being arranged between said at least two pair of said large-diameter contact drying cylinders, said hood being arranged above said one of said small-diameter contact drying cylinders and one of said large-diameter contact drying cylinders of each pair of said large-diameter contact drying cylinders adjacent said one of said small-diameter contact drying cylinders.

15. The dryer section of claim 1, wherein said at least one large-diameter contact drying cylinder comprises a plurality of large-diameter contact drying cylinders arranged at a first level, one of said reversing cylinders being arranged in every other gap between adjacent ones of said large-diameter contact drying cylinders and at a second level below said first level, said small-diameter contact drying cylinders being arranged at a third level below said second level of reversing cylinders and in remaining gaps between adjacent ones of large-diameter contact drying cylinders, one of said reversing cylinders being arranged between each of said small-diameter contact drying cylinders and the adjacent ones of said large-diameter contact drying cylinders and at a fourth level below said third level of small-diameter contact drying cylinders, said hood being arranged inside said loop of said drying wire above said one of said small-diameter contact drying cylinders.

16. The dryer section of claim 1, wherein said at least one large-diameter contact drying cylinder comprises a single large-diameter contact drying cylinder arranged between two of said small-diameter contact drying cylinders without the interposition of one of said reversing cylinders between said large-diameter contact drying cylinder and said two small-diameter contact drying cylinders, said drying wire being removed from contact with the web such that the web is passed in direct contact with said large-diameter contact-drying cylinder, further comprising an additional drying wire guided in a loop and arranged to press the web against said large-diameter contact drying cylinder, said hood being arranged in said drying-wire loop.

17. The dryer section of claim 16, wherein said large-diameter contact drying cylinder and said additional drying wire form a hood module situated in a basement space below a floor level of a paper machine hall in which the dryer section is situated.

18. The dryer section of claim 1, wherein said at least one of said single-wire draw groups, is situated at a final end of the dryer section such that evaporation of water from the web through the said drying wire is enhanced by said hood.

19. The dryer section of claim 1, further comprising a drying module arranged after a first one of said single-wire draw groups without any large-diameter contact drying cylinders, said drying module comprising a drying wire guided in a loop, a large-diameter impingement drying cylinder arranged in said loop of said drying wire, said drying wire being guided over said large-diameter cylinder such that a contact sector of said drying wire over said large-diameter cylinder is greater than about 180°, a blow hood arranged around said large-diameter cylinder and having an open position and a closed position, and a pair of smooth-faced heated contact-drying cylinders having a diameter smaller than a diameter of said large-diameter cylinder, each of said pair of contact-drying cylinders being situated on a respective side of said large-diameter cylinder at least one of above said large-diameter cylinder and proximate said large-diameter cylinder; and a second one of said single-wire draw groups without any large-diameter contact drying cylinders arranged after said drying module, said at least one of said single wire draw groups including said at least one large-diameter contact drying cylinder being arranged after said second one of said single-wire draw groups without any large-diameter contact drying cylinders.

20. The dryer section of claim 19, wherein the paper machine is situated in a paper machine hall having a floor level, said large-diameter cylinder in said drying module being arranged below the floor level of the paper machine hall, said single-wire draw groups being arranged above said large-diameter cylinder in said drying module and above the floor level of the paper machine hall.

21. The dryer section of claim 19, further comprising a broke conveyor arranged underneath said single-wire draw groups and said blow hood of said drying module such that while in the hood open position, the removal of broke from said blow hood takes place by the force of gravity onto said broke conveyor.

22. The dryer section of claim 1, further comprising first and second drying modules each comprising a drying wire guided in a loop, a large-diameter impingement cylinder arranged in said loop of said drying wire, said drying wire being guided over said large-diameter cylinder such that a contact sector of said drying wire over said large-diameter cylinder is greater than about 180°, a blow hood arranged around said large-diameter cylinder and having an open position and a closed position, and a pair of smooth-faced heated contact-drying cylinders having, a diameter smaller than a diameter of said large-diameter cylinder, each of said pair of contact-drying cylinders being situated on a respective side of said large-diameter cylinder at least one of above said large-diameter cylinder and proximate said large-diameter cylinder, a first dryer group in the dryer section arranged before said single-wire draw groups in a running direction of the web, said first dryer group comprising a drying wire guided in a loop such that said drying wire is adapted to receive the web from a press section preceding the dryer section and carry the web in a run of said drying wire, a first one of said single-wire draw groups without any large-diameter contact drying cylinder being arranged after said first dryer group, said first drying module being arranged after said first of said single-wire draw groups, a second one of said single-wire draw groups without any large-diameter contact drying cylinder being arranged after said first drying module, said second drying module being arranged after said second of said single-wire draw groups, said at least one of said single-wire draw groups including said at least one large-diameter contact drying cylinder being arranged after said second drying module.

23. The dryer section of claim 1, further comprising means arranged in said hood for dividing said hood into a plurality of blocks in a cross-machine direction, said hood being arranged such that independently regulatable drying gas flows are directed into each of said blocks to thereby regulate a cross-direction profile of a web to be dried.

* * * * *

UNITED STATES PATENT AND TRADEMARK OFFICE

CERTIFICATE OF CORRECTION

PATENT NO. : 6,101,735
DATED : August 5, 2000
INVENTOR(S) : Antti Kuhasalo, et al.

It is certified that error appears in the above-identified patent and that said Letters Patent is hereby corrected as shown below:

Title page,
Item [30] should read --Apr. 22, 1997 [FI] Finland.....971715--.

Signed and Sealed this

Seventeenth Day of July, 2001

*Attest:*

Nicholas P. Godici

NICHOLAS P. GODICI
*Acting Director of the United States Patent and Trademark Office*

*Attesting Officer*